United States Patent [19]

Simpson

[11] 4,163,551

[45] Aug. 7, 1979

[54] VAULTING PRACTICE BOX

[76] Inventor: Bruce A. Simpson, 130 Howland Ave., Toronto, Ontario, Canada, M5R 3B5

[21] Appl. No.: 881,906

[22] Filed: Feb. 27, 1978

[51] Int. Cl.[2] ..... A63B 5/00
[52] U.S. Cl. ..... 272/104
[58] Field of Search ..... 272/101-105

[56] References Cited

U.S. PATENT DOCUMENTS

| | | | |
|---|---|---|---|
| 1,168,666 | 1/1916 | Medart | 272/104 |
| 3,075,765 | 1/1963 | Mpakarakes | 272/104 |

FOREIGN PATENT DOCUMENTS

| | | | |
|---|---|---|---|
| 923242 | 4/1963 | United Kingdom | 272/104 |

OTHER PUBLICATIONS

"The Sporting Goods Dealer"; Dec. 1974; p. 110.

*Primary Examiner*—Richard J. Apley
*Attorney, Agent, or Firm*—Sim & McBurney

[57] ABSTRACT

There is provided a practice box for pole vaulters, which defines a wedge-shaped recess converging in the forward direction, open upwardly and open rearwardly. The practice box has side edges defining the convergence, which side edges are provided with means for retaining the inertial weight in such a way as to oppose a forward thrust in the practice box. In use the inertia of the practice box allows the vaulter at least to lift-off the ground, but the forward thrust exerted by the pole allows the vaulter to return to the ground without completing the jump. The purpose is to permit practice of the lift-off without requiring a full jump.

4 Claims, 8 Drawing Figures

VAULTING PRACTICE BOX

This invention relates generally to the sport of pole vaulting, and has to do particularly with a practice box which the vaulter can utilize to allow him to practice the take-off portion of the jump, without having to follow through with the complete jump.

BACKGROUND OF THIS INVENTION

Pole vaulting is a particularly strenuous sport, with each jump placing considerable strain on the physical body of the vaulter. Most of the strain arises as the vaulter is utilizing the inertia of his initial run and the strength in his arms to swing his body through an arc into a upside-down position on the pole, just prior to passing over the cross-bar. In this position, the vaulter is "standing on his hands", with the hands gripping the pole. The final "kick" to get the vaulter over the cross-bar comes partly from the pole itself, which nowadays is a fibreglass pole with considerable resilience and capacity for bending.

In performing his jump, the vaulter firstly paces off his "run" backward from the vaulting box, which is normally a fixed box recessed into the ground or track. The box is typically wedge-shaped with a gradually increasing depth into the ground in the forward direction, while the sides converge in the forward direction. The vaulter, holding the pole toward the upper end, then commences his run toward the vaulting box with most of the pole being held forwardly in front of him.

Running close to or at his top speed, the vaulter places the leading end of the pole into the vaulting box and at the same time executes the "take-off", which typically involves leaping off the ground usually on his left foot, at the same time swinging the right foot forwardly and upwardly in order to take advantage of the inertia of his running speed. With such a take-off, the vaulter swings past the pole to the right of the pole, pulling himself up to a position in which his arms and hands are at the bottom and the remainder of the body extends upwardly from the hands.

Between the take-off and the latter "handstand" position, the conventional fibreglass pole will normally bend through a considerable arc. By the time the vaulter reaches the "handstand" position, the pole is beginning to straighten itself out, and in so doing it gives an additional upward thrust to the vaulter's body, which is utilized to gain extra height in the jump.

An extremely critical point in the jump is the take-off just described. In the take-off, the vaulter must propel his body into the jump at just the right speed and from just the right position with respect to the vaulting box. Because the position of take-off is so critical, the run up to the vaulting box is also of extreme importance to making a good jump. If a vaulter, in practicing his sport, were required to execute a complete vault every time he attempted to work on the take-off or the run up to the box, he would become exhausted very quickly, and probably no more than a dozen or so such attempts could be made at any one time.

SUMMARY OF THIS INVENTION

In view of the foregoing, it is an aim of this invention to provide a non-fixed vaulting practice box which allows the vaulter to practice only the run and the take-off if he wishes, or to work on the impulsion generated at take-off, without requiring him to follow through with the handstand and release portion of the jump. This allows the vaulter to undertake many more practice runs at any given time, because it places less strain on his body and does not tax his strength to the same degree.

Accordingly, this invention provides a vaulting practice box comprising a flat horizontal bottom wall having a rear edge, and having side edges converging forwardly from said rear edge and a front end, side walls extending upwardly from said side edges and integral therewith, said side walls closing together at the front to form an integral structure extending upwardly from the front end of the bottom wall, and means integral with each side wall defining a pocket outwardly adjacent each side wall, said pockets being adapted to receive and retain inertial weights.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
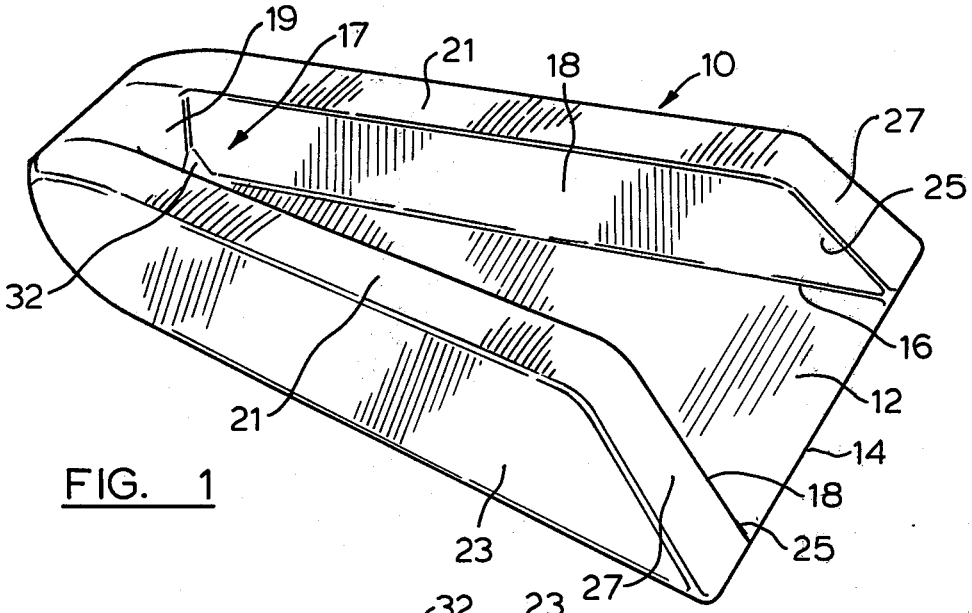
FIG. 1 is a perspective view of a vaulting practice box constructed in accordance with this invention, seen from above and to the rear.

Attention is firstly directed to FIGS. 1-4, in which a vaulting practice box is designated by the numeral 10, and is seen to include a flat horizontal bottom wall 12 having a rear edge 14, side edges 16 which converge forwardly from the rear edge 14, and a front end portion 17. Side walls 18 extend upwardly from the side edges 16 and are integral therewith. As can be seen particularly in FIGS. 1 and 2, the side walls 18 close together at the front to form an integral structure including a front wall 19 which extends upwardly from the front end of the bottom wall 12.

The vaulting practice box of this invention is designed in such a way as to allow it to retain inertial weights such that the inertia of the weights opposes any forward thrust on the practice box 10. In order to accomplish this, the structure of each side wall 18 merges integrally into a top wall 21 of uniform width along each side wall 18, and the top wall then merges with an outside wall 23 which returns again downwardly alongside but spaced from the respective side wall 18.

As can be seen best in FIG. 1, each side wall 18 has a downwardly and rearwardly sloping rear edge 25, and at this edge is provided a rearward wall 27 which is integrally formed with the respective top wall 21, side wall 18 and outside wall 23.

It is thus seen that each side wall 18, outside wall 23, top wall 21 and rearward wall 27 defines a downwardly and forwardly open pocket. It is intended that these pockets receive inertial weights, which may be wood, lead, iron, masonry or the like. One such weight is shown in FIG. 2 at 30, partly extending out of the pocket into which it is intended to fit.

Figure 2:
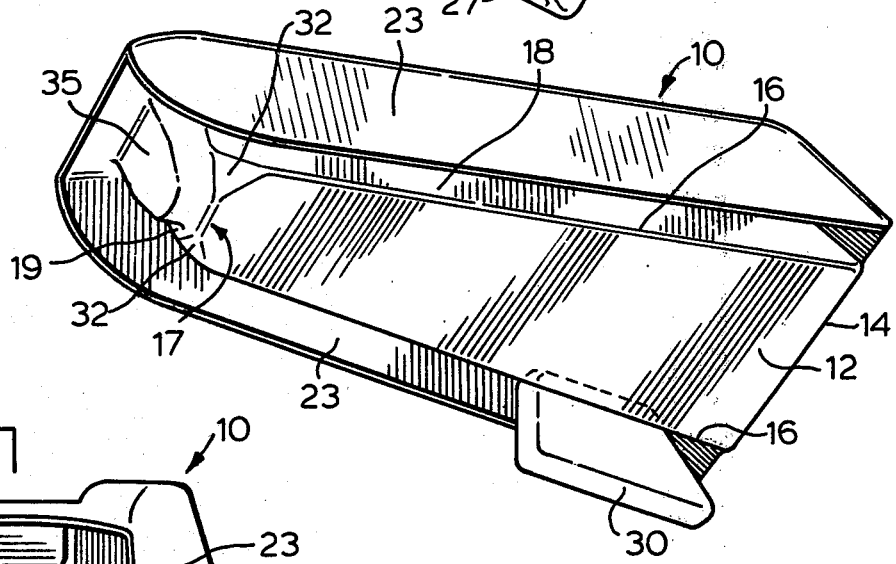
FIG. 2 is another perspective view of the same vaulting practice box, seen from below and toward the front.
Figure 3:
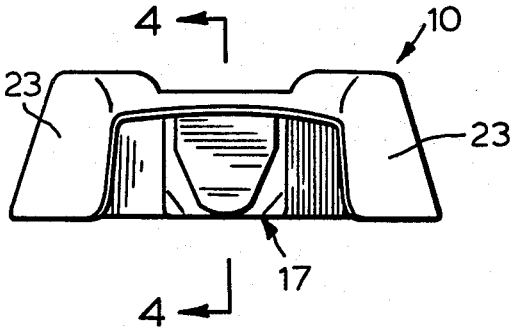
FIG. 3 is a frontal end elevation of the vaulting practice box of FIG. 1.

As seen in FIG. 2, the corners of the bottom wall 12 at the front end are blunted at 32 in order to relieve stress concentration, and furthermore the front wall 19 is reinforced forwardly by a piece of wood 34 (seen in section in FIG. 4), the outline of which can be seen in FIG. 2 at the numeral 35.

Figure 4:
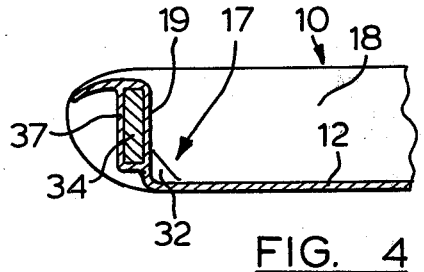
FIG. 4 is a longitudinal sectional view taken at the line 4—4 in FIG. 3.

The embodiment illustrated is constructed of fibreglass reinforced plastic, and in this construction, the block of wood 34 is sealed within a closed pocket defined by the front wall 19 and a surrounding wall 37 of plastic (see FIG. 4).

The use of the practice vaulting box is illustrated in FIGS. 5–8, to which attention is now directed.

Figure 5:
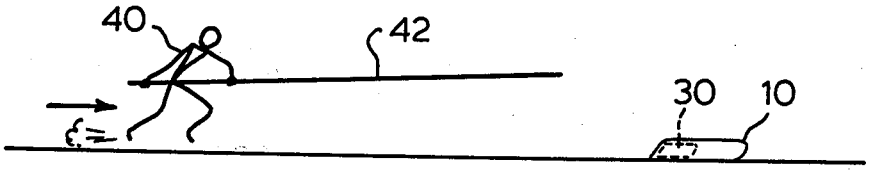
FIGS. 5-8 are sequential views showing a pole vaulter utilizing the vaulting practice box of this invention.

FIG. 5 shows the vaulter 40 making his running approach to the practice box 10, the latter simply sitting down upon the track, with weights 30 in place within the pockets defined earlier. Thus, the presence of the weights will add inertia to the box 10 resisting forward thrust.

Figure 6:
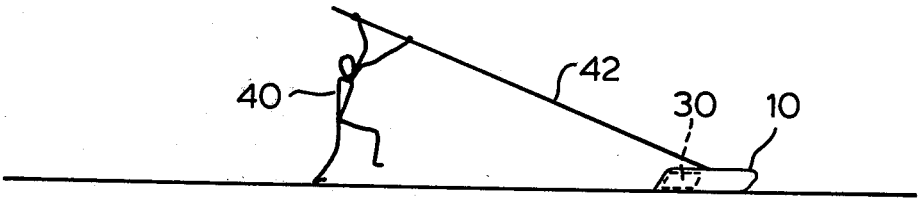

At FIG. 6, the vaulter has inserted the forward end of the pole 42 into the practice box 10, and is swinging his right foot forwardly and upwardly while leaping off the ground on his left leg.

Figure 7:
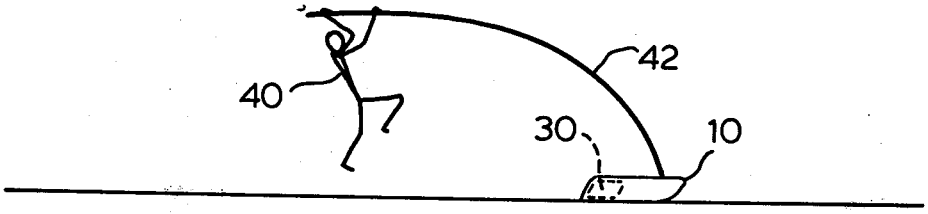
Figure 8:
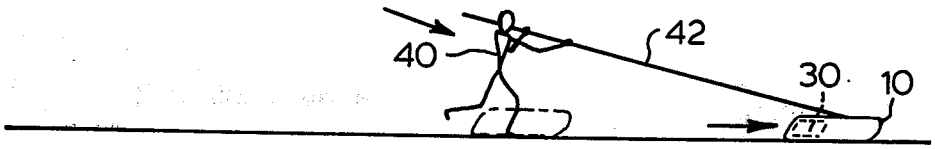

FIG. 7 shows the vaulter in mid-air, with the right leg still swinging upwardly, and with the pole 32 bent through a considerable arc. As the pole bends and the vaulter swings up into the air, a gradually increasing forward thrust is placed against the vaulting box 10. Depending upon the inertia of the weights 30, a particular point is reached at which the forward thrust on the box 10 overcomes the inertia and the standing friction between the box 10 and the track, whereupon the box 10 starts to slide forwardly at an ever increasing speed under the thrust exerted by the bent pole 32. As soon as the box begins to slide forwardly, the combination of forces tending to lift the vaulter into the air is suddenly relaxed, and the vaulter drops down lightly onto the ground from a relatively low height. This is shown in FIG. 8.

I claim:

1. A vaulting practice box comprising a flat horizontal bottom wall having a rear edge, and having side edges converging forwardly from said rear edge and a front end, side walls extending upwardly from said side edges and integral therewith, said side walls closing together at the front to form an integral structure extending upwardly from the front end of the bottom wall, and means integral with each side wall defining a pocket outwardly adjacent each side wall, said pockets being adapted to receive and retain inertial weights.

2. The box defined in claim 1, in which each side wall defines the inside wall of its pocket, each pocket being further defined by a top wall, an outside wall and a rearward wall, all such walls being integral, the pockets being downwardly open and being rearwardly and laterally closed.

3. The box defined in claim 2, in which said integral structure is reinforced to withstand shock loading.

4. The box defined in claim 2, in which the entire box is of reinforced plastic, and in which a wooden reinforcing element is embedded in the plastic adjacent the said integral structure at the front of the box.

* * * * *